US011639716B2

(12) United States Patent
Bückle et al.

(10) Patent No.: US 11,639,716 B2
(45) Date of Patent: May 2, 2023

(54) PERISTALTIC PUMP

(71) Applicant: ulrich GmbH & Co. KG, Ulm (DE)

(72) Inventors: Norbert Bückle, Bernstadt (DE); Torsten Koch, Neu-Ulm (DE); Felix Seibold, Ulm (DE)

(73) Assignee: ulrich GmbH & Co. KG, Ulm (DE)

( * ) Notice: Subject to any disclaimer, the term of this patent is extended or adjusted under 35 U.S.C. 154(b) by 171 days.

(21) Appl. No.: 17/195,018

(22) Filed: Mar. 8, 2021

(65) Prior Publication Data

US 2021/0277884 A1 Sep. 9, 2021

(30) Foreign Application Priority Data

Mar. 9, 2020 (DE) ..... 10 2020 106 372.5

(51) Int. Cl.

*F04B 43/12* (2006.01)
*F04B 43/08* (2006.01)
*F04B 53/22* (2006.01)
*F04B 53/00* (2006.01)

(52) U.S. Cl.

CPC ..... *F04B 43/1253* (2013.01); *F04B 43/08* (2013.01); *F04B 53/00* (2013.01); *F04B 53/22* (2013.01)

(58) Field of Classification Search

CPC .... F04B 43/086; F04B 43/08; F04B 43/1253; F04B 43/088; F04B 43/1292; F04B 53/00; F04B 53/22; A61M 1/155; A61M 5/14232

USPC ..... 417/477.3

See application file for complete search history.

(56) References Cited

U.S. PATENT DOCUMENTS 2,987,004 A * 6/1961 Murray ..... F04B 43/1261 91/218
3,841,799 A * 10/1974 Spinosa ..... A61M 5/142 417/477.2
9,874,207 B2 2/2018 Bückle
2009/0263256 A1 10/2009 Bobo et al.
2013/0045121 A1 2/2013 Rodau et al.

(Continued)

FOREIGN PATENT DOCUMENTS

DE 202016101907 U1 7/2017
EP 2542781 A1 1/2013
EP 2924288 A2 9/2015

OTHER PUBLICATIONS

Result of Examination Report for German Patent Application No. 10 2020 106 372.5, filed Mar. 9, 2020.

*Primary Examiner* — Philip E Stimpert
(74) *Attorney, Agent, or Firm* — Paul D. Bianco; Fielt Intellectual Property Law

(57) ABSTRACT

A peristaltic pump for conveying a fluid guided in a hose includes a hose bed having a counter bearing to accommodate the hose, a support disk rotatable relative to counter bearing, a plurality of squeeze rolls positioned in the peripheral direction on the support disk and a plurality of guide rollers positioned in the peripheral direction on the support disk with a guide groove extending in the peripheral direction on its outer circumference, which forms a first guide plane facing the support disk. In order to be able to provide reliable loading and unloading of different hoses with different properties into the hose bed or from the hose bed, each guide roller has a guide cylinder above the guide groove to guide the hose during loading into the hose bed and/or during unloading from the hose bed.

17 Claims, 9 Drawing Sheets

(56) References Cited

U.S. PATENT DOCUMENTS

| | | | |
|---|---|---|---|
| 2017/0292510 | A1 | 10/2017 | Bückle |
| 2017/0306943 | A1 | 10/2017 | Hays et al. |

* cited by examiner

PERISTALTIC PUMP

FIELD OF THE DISCLOSURE

The disclosure concerns a peristaltic pump.

BACKGROUND

Such peristaltic pumps are known, for example, from DE 20 2016 101 907 U1 and EP2 924 288 A2. These known peristaltic pumps have a hose bed into which a looped hose section of a hose can be inserted. The known peristaltic pumps also include a counter bearing and a support disk rotatable relative to the counter bearing, on top of which a plurality of squeeze rollers and a plurality of guide rollers are positioned. In this case both the squeeze rollers and the guide rollers are positioned equidistant from each other in the radially outer area of the support disk and in the circumferential direction of the support disk, in which case one guide roller is positioned between every two consecutive squeeze rollers in the circumferential direction of the support disk. For example, in one illustrative embodiment of the known peristaltic pumps three squeeze rollers and guide rollers each are provided, having an angular spacing of 60° to the adjacent squeeze roller or guide roller in the circumferential direction of the support disk. The squeeze rollers have a smooth outer circumference and, when the support disk is rotating in a feed direction, press against a hose inserted into the hose bed, squeezing the hose against a counter bearing in order to transport a fluid in the hose in the feed direction. The cylindrical guide rollers have on their outer circumference a guide groove running in the circumferential direction to accommodate the radially inward hose halves of the hose section and ensure precise positioning and guiding of the hose in the hose bed both during loading of the hose section in the hose bed and during pump operation.

A motor-driven device with a screw spindle can be used for automated loading and unloading of the hose section in the hose bed, as described, for example, in EP 2 542 781 A1. Such a motor-driven device for loading and unloading of the hose, however, is cost-intensive. As an alternative to this, for loading into the hose bed the hose section can also be pressed with a hold-down device against a contact area at the inlet of the hose bed and grasped by one of the guide rollers when the support disk is rotating and then pulled into the hose bed, the radially inward area of the hose section being taken up in the guide groove of the guide roller and pressed in the axial direction downward onto a contact area in the hose bed. Problems can occur if the hose section is too short or too long. If the hose section is too short, there is a risk that the hose section will be stretched too strongly during loading and will thereby slip out of the guide groove of the guide roller. If the hose section is too long, problems can occur both during loading of the hose into the hose bed and also during operation of the peristaltic pump, because the hose section at the outlet of the hose bed forms a loop protruding above the contact area of the hose bed and therefore is not smoothly guided in the hose bed. During operation of the peristaltic pump, especially at very high pump pressures, which can reach as much as 20 bar in the intended operation, the downstream end of an unduly long hose section may slip out of the guide groove of the guide rollers and thereby be raised from the contact area of the hose bed. This can result in the hose section being automatically and unintentionally unloaded and jammed during operation of the peristaltic pump. The peristaltic pump can thus become blocked.

It has also been shown that the problems described during loading of the hose also depend very strongly on the mechanical properties of the hose, especially its stretchability and friction properties. The mechanical properties of the hose depend on many different factors, like the material composition, age and pretreatment of the hose, for example, by cleaning and sterilization. The material properties of the hose can change over time during storage, for example, due to the release of material components, especially the plasticizers contained in the plastic composition. The behavior of a hose during loading and unloading can therefore be quite different, which seriously hampers correct loading and unloading of different hoses.

SUMMARY

Starting from this, one aspect of the disclosure is to modify a generic peristaltic pump so that reliable loading and unloading of hose sections of different pump hoses, especially different pump hoses having a different material composition and different material properties, is made possible.

Reliable loading and unloading of a hose section of the hose into the hose bed of the hose pump is also to be ensured if the hose section is a bit too short or too long in comparison with the inside circumference of the counter bearing. Automatic unloading of the inserted hose section is to be prevented during operation of the peristaltic pump, especially under high pump pressures, and blockage of the peristaltic pump must not occur during inadvertent unloading of the hose during the loading process or during pump operation.

A peristaltic pump and related method are disclosed herein. Preferred embodiments of the peristaltic pump and the method are also disclosed.

The peristaltic pump according to the disclosure has a hose bed for insertion of a hose section of a pump hose, a counter bearing, a support disk rotatable relative to the counter bearing, a plurality of squeeze rollers preferably arranged equidistant from each other in the circumferential direction on the support disk and a plurality of guide rollers preferably arranged equidistant from each other in the circumferential direction on the support disk with a guide groove running in the circumferential direction on their outer circumference, forming a first guide plane facing the support disk. According to the disclosure, each guide roller has a guide cylinder facing away from the support disk above the guide groove for initial guiding of the hose during loading into the hose bed and/or during unloading from the hose bed.

The guide cylinder of the guide rollers then serves for initial guiding of the hose during loading of the hose into the hose bed and, during rotation of the support disk in a feed direction, enables reliable initial guiding of the hose and secure introduction of the hose into the guide grooves of the guide rollers, which face the support disk and, with the support disk rotating in the feed direction, ensure positionally accurate guiding of the hose in the hose bed during operation of the peristaltic pump.

For loading of the hose into the hose bed of the peristaltic pump, the hose is initially inserted into a second guide plane formed by the guide cylinders of the guide rollers facing away from the support disk, and the support disk then rotated in the feed direction. The hose is then brought from the second guide plane into the first guide plane defined by the guide grooves in the axial direction on the support disk. The hose section initially inserted into the second guide plane during loading in an area at the inlet of the hose bed is either manually pressed downward by an operator or by means of a mechanical hold-down device of the peristaltic pump in the direction toward the surface of the support disk, in order to make sure that during rotation of the support disk the inserted hose section is grasped by (at least) one guide roller and transferred from the upper second guide plane downward into the first guide plane.

The squeeze rollers of the peristaltic pump according to the disclosure are expediently designed to be at least essentially cylindrical and with a smooth outer surface, the outer circumference of the cylindrical squeeze rollers pressing the hose against the counter bearing in order to transport a fluid in the hose in the feed direction.

The guide groove extending on the outer circumference of the guide rollers is preferably adapted to the shape of the hose and the guide groove, in particular, and can have an at least essentially semicircular cross section, in particular for a hose with a circular cross section. Owing to the semicircular shape of the guide groove on the outer circumference of the guide rollers, they are nestled during operation of the peristaltic pump against the surface of the hose without squeezing it. Reliable and uniform guiding of the hose in the hose bed is then provided when the peristaltic pump is running.

An annular flange extending on the outer circumference of the guide roller is preferably arranged in each guide roller between the guide groove and the guide cylinder positioned above the guide groove. This annular flange separates the guide groove from the guide cylinder of the corresponding guide roller and in so doing defines the first guide plane facing the support disk in the area of the guide grooves and the second guide plane facing away from the support disk in the area of the guide cylinder of the guide rollers. The second guide plane is then axially offset relative to the first guide plane and positioned above the first guide plane. When the words from above or above are used here, this means a direction perpendicular to the surface of the support disk, which forms a guide surface for a hose inserted into the hose bed. There is no restriction here with reference to orientation of the peristaltic pump, since it can be operated both in a horizontal and a vertical position of the support disk.

The formation of an upper second guide plane facing away from the support disk enables the operator of the peristaltic pump during loading of the hose to initially insert the hose section being loaded simply and free of hindrance into the upper second guide plane, in which case the hose section inserted therein is initially guided. A prestress is then exerted on the hose in its longitudinal direction by the guide cylinder around which the inserted hose section is positioned so that the hose is stretched slightly, depending on the elongation properties thereof. For loading of the inserted hose section into the hose bed the support disk is then rotated in the feed direction, in which case a first guide roller grasps the hose section at an inlet of the hose bed. Owing to the prestress of the hose, it is pulled during rotation of the support disk from the upper second guide plane downward onto the support disk into the lower first guide plane (with slight stretching of the hose) until the area of the inserted hose section lying at the inlet of the hose bed engages in the guide groove of the first guide roller. By further rotating the support disk in the feed direction, the inserted hose section is thus brought over the entire circumference of the support disk from the upper second guide plane into the lower first guide plane until the inserted hose section comes to lie neatly in the guide groove of all guide rollers and is therefore inserted ready for operation in the hose bed.

The prestress exerted by the guide cylinders of the guide rollers on the inserted hose section guarantees that the hose has the least possible contact with the counter bearing during loading. This prevents the hose from rubbing against the counter bearing and prevents the different friction properties of the different hoses from having a (negative) effect on loading of the hose. The loading process is thus largely independent of the mechanical properties of the hose. Identical and reliable loading of different hoses of possibly different material parameters is therefore made possible, as well as a gentle loading of the hose.

Particularly reliable initial guiding of the hose during loading is achieved if the second guide plane includes a half-groove running on the outer circumference of the guide roller, because the inserted hose section can then nestle properly against the preferred half-groove shape of the second guide plane. Because of the half-groove design of the second guide plane, which has a cross section of a quarter circle, simple an unimpeded insertion of a hose section being loaded into the upper second guide plane is also made possible.

The height of a guide cylinder of a guide roller, i.e., the distance from the top front of the guide cylinder to the annular flange is preferably at least as large in each guide roller as the diameter of the hose. During loading this also ensures proper initial guiding of the hose into the second guide plane, because the hose is guided by the guide cylinder over its entire diameter.

The squeeze rollers are preferably designed to be at least essentially cylindrical with a flat top, the guide cylinder of the guide rollers preferably lying in the axial direction above the top of the squeeze rollers. This prevents jamming of the inserted hose section during loading or during operation of the peristaltic pump and blockage of the peristaltic pump. This arrangement also enables trouble-free insertion of a hose section to be loaded in the hose bed into the second guide plane.

The peristaltic pump according to the disclosure is designed for operation with a single hose. Accordingly, (only) one hose is inserted into the hose bed for operation of the peristaltic pump so that the squeeze rollers, press the hose against the counter bearing while the support disk is rotating, in order to transport a fluid in the hose in the feed direction.

In a preferred embodiment of the peristaltic pump, the annular flange and at least one guide roller of the plurality of guide rollers are positioned between the guide groove and the guide cylinder axially offset upward away from the support disk in comparison with the annular flange of the other guide rollers. Loading of the hose while rotating the support disk ensures reliable trapping of the hose section inserted into the upper second guide plane by this guide roller with the axially upward offset annular flange, because the somewhat upward offset annular flange creates an enlargement of the insertion cross section of the guide groove of this guide roller and in so doing enables easier engagement of the hose section at the inlet of the hose bed. This ensures that the hose section inserted into the upper second guide plane during rotation of the support disk in each case is grasped by this guide roller with the axially upward offset annular flange and pulled downward into the lower first guide plane, even if the guide rollers possibly positioned farther ahead in the feed direction have not properly grasped the hose and pulled it downward into the first guide plane. At the same time, trouble-free unloading of the hose is ensured during rotation of the support disk in the direction opposite the feed direction, which will be explained in detail below.

As already mentioned, reliable guiding of a hose section loaded into the hose bed during operation of the peristaltic pump is achieved if the guide groove of at least one or each guide roller has at least an essentially partially circular, in particular, semicircular cross section. The cross section of the guide roller with the axially offset annular flange can then also expediently deviate from a partially circular or semicircular cross section in order to form an enlarged insertion cross section in the area of the lower first guide plane.

The guide roller with the axially upward offset annular flange, owing to the axial offset in comparison with the other guide rollers, then has a large insertion cross section in the area of the lower first guide plane and therefore enables easier transfer of the hose from the upper second guide plane into the lower first guide plane in comparison with the other guide rollers. On the other hand, the other guide rollers during unloading of the hose (which occurs with rotation of the support disk in the direction opposite the feed direction) ensures that the annular flange offset axially somewhat downward toward the support disk can pass beneath the hose section in the area of the outlet of the hose bed during the unloading process and in so doing rise from the lower first guide plane to the upper second guide plane.

In a preferred embodiment, an elevation is positioned at the outlet of the hose bed, which protrudes above the surface of the support disk, in order to support the annular flange of at least one of the guide rollers under the hose section inserted in the tube bed during unloading of the hose while rotating the support disk in the direction opposite the feed direction.

During loading of the hose, in order to prevent a hose section from coming to lie in a radially inward region (viewed with reference to the support disk) of the outer circumference of the guide rollers and therefore not being properly grasped by this guide roller and inserted into the hose bed between the outer circumference of the guide roller and the counter bearing, a cover is expediently provided, which covers the guide rollers and lies on the top of the guide rollers. The cover is then preferably designed cross- or star-shaped and has indentations, in particular in the area between two adjacent guide rollers, which can be shaped convex or partially circular. The indentations then serve for manual engagement of the cover so that an operator can grip the cover in an ergonomically optimal fashion and place the support disk in rotation manually by exerting a torque on the cover and above the guide rollers fastened thereto. This enables manual rotation of the support disk during loading or unloading of the hose without requiring the use of pump motor. The cover can also have protrusions instead of indentations, which in particular can be convex or partially circular. Openings can also be provided in the cover, into which an operator can insert one or more fingers for manual rotation of the support disk (in the fashion of a telephone dial).

In order to place the support disk in rotation during operation of the pump, the support disk is preferably connected to a shaft that is coupled to a motor and can be placed in rotation thereby. The guide rollers and the squeeze rollers are preferably mounted so as to rotate on the support disk in order to enable friction-free rolling on the surface of the hose. However, they can also be connected non-rotationally to the support disk. The axis of rotation of the support disk (axis of the shaft) and the axes of the squeeze rollers and the guide rollers then run parallel to each other. If the guide rollers and the squeeze rollers are mounted to rotate on the support disk, they can be placed in rotation by the motor (optionally via a gear mechanism). The guide rollers and the squeeze rollers, however, can also be mounted (passively) rotatable on the support disk without coupling to a drive.

If the guide rollers mounted to rotate on the support disk are actively placed in rotation by the motor, reliable transfer of the hose from the upper second guide plane into the lower first guide plane can be achieved during loading if at the same time the annular flange in the feed direction is sloped so as to spiral downward toward the support disk. In this embodiment the hose section inserted into the second guide plane is brought from the upper second guide plane into the lower first guide plane by the downwardly spiraling annular flange during rotation of the support disk and simultaneous active rotation of the guide rollers relative to the support disk.

In a preferred arrangement, one guide roller each is arranged between two squeeze rollers in the circumferential direction on the support disk, in which case the squeeze rollers, with the support disk rotating in the feed direction, press a hose (or hose section) inserted in the hose bed against the counter bearing while squeezing the hose, in order to transport a liquid located in the hose in the feed direction. During operation of the peristaltic pump this preferred arrangement ensures clean guiding of the hose over the entire circumference of the support disk.

It is then advantageous if the spacing between the squeeze and guide rollers is not equidistant (i.e., asymmetric) over the circumference of the support disk. In a preferred embodiment of the peristaltic pump according to the disclosure, the guide rollers are offset back in relation to the squeeze rollers that follow them in the feed direction (direction of rotation of the support disk during pump operation of the peristaltic pump), i.e., the angular spacing ($\delta$) between a guide roller and the squeeze roller following this guide roller in the feed direction is smaller than the angular spacing ($\Delta$) between this guide roller and the squeeze roller preceding this guide roller in the feed direction. This arrangement of the squeeze rollers and the guide rollers on the support disk, during loading of the hose into the hose bed, prevents a situation in which the upstream section of the hose can slip out of the guide groove of a guide roller, because the guide roller directly follows a squeeze roller during rotation of the support disk, i.e., under only a slight angular spacing $\delta$, which forces the upstream section of the hose against the counter bearing and in so doing fixes the position of the section of the hose already introduced into the hose bed in the hose bed.

During operation of the peristaltic pump, undesired unloading of the hose is prevented by the preferred asymmetric arrangement of the squeeze rollers and the guide rollers on the support disk, because each squeeze roller runs directly ahead of a guide roller during rotation of the support disk, i.e., under only a slight angular spacing $\delta$, which reliably secures the downstream section of the hose in the hose bed even at high pump pressures and prevents the downstream end of the hose from bulging into a loop at the outlet of the hose bed, whereas the section of the hose lying somewhat farther back in the feed direction is pressed against the counter bearing by the squeeze roller.

The amount of relative angular difference ($\Delta-\delta/\Delta+\delta$) between the angular distance $\Delta$ between a guide roller and the squeeze roller preceding this guide roller in the feed direction and the angular distance $\delta$ between this guide roller and the squeeze roller following this guide roller in the feed direction is preferably in the range of 0.2 to 0.5.

The guide rollers and the squeeze rollers are expediently positioned rotationally symmetrical (with reference to the axis of rotation of the support disk as center of symmetry) on the support disk, the symmetry angle being 360°/n, when n is the number of guide rollers and squeeze rollers.

In a preferred embodiment the peristaltic pump according to the disclosure has three or more squeeze rollers and an equal number of guide rollers, which are positioned on the radially outer edge of the support disk so that the angular spacing (δ) between each guide roller and the squeeze roller following a guide roller in the feed direction is less than 60° and in particular (when there are three guide rollers and three squeeze rollers) is preferably 45°. Accordingly, the angular spacing (Δ) between a guide roller and the squeeze roller preceding this guide roller in the feed direction is greater than 60° and in particular at least 75°. In this arrangement with three squeeze rollers and three guide rollers, the amount of relative angular difference is preferably $\Delta-\delta/\Delta+\delta=0.25$. In an alternative arrangement with four squeeze rollers and four guide rollers, the amount of relative angular difference is preferably $\Delta-\delta/\Delta+\delta=0.33$.

The peristaltic pump according to the disclosure preferably includes a device to monitor the loading process during loading of a hose into the hose bed. A particularly simple device for monitoring the loading process then includes a device to detect the torque acting on the support disk. By detecting the torque acting on the support disk a simple and reliable determination can be made as to whether the hose is properly loaded. If the hose is properly loaded, the torque acting on the support disk increases, because the motor that sets the support disk in rotation is running against a higher rotational resistance.

To indicate a properly concluded loading process, a signal emitter is preferably provided, which produces a first signal when a torque threshold value is exceeded. In order to indicate defective or improper loading, the signal emitter can also be set up so that after a stipulated time a second signal is produced if the torque threshold value has not been reached or exceeded within this time period. In this manner, the operator of the peristaltic pump according to the disclosure expediently acquires information concerning the state of the peristaltic pump and the status of the loading process during each loading process.

The status of the loading process determined by the device for monitoring the loading process can then also be used to control an automatic loading routine, in which, for example, after a failed loading process, a further loading process is automatically started. The same preferably also applies to unloading of the hose, in which case successful unloading of a hose is concluded a torque threshold value has not been reached.

BRIEF DESCRIPTION OF THE DRAWINGS

These and other advantages and features of the peristaltic pump according to the disclosure will become apparent from the following illustrative embodiment described in greater detail below with reference to the accompanying drawings. The drawings show.

DETAIL DESCRIPTION

Figure 1:
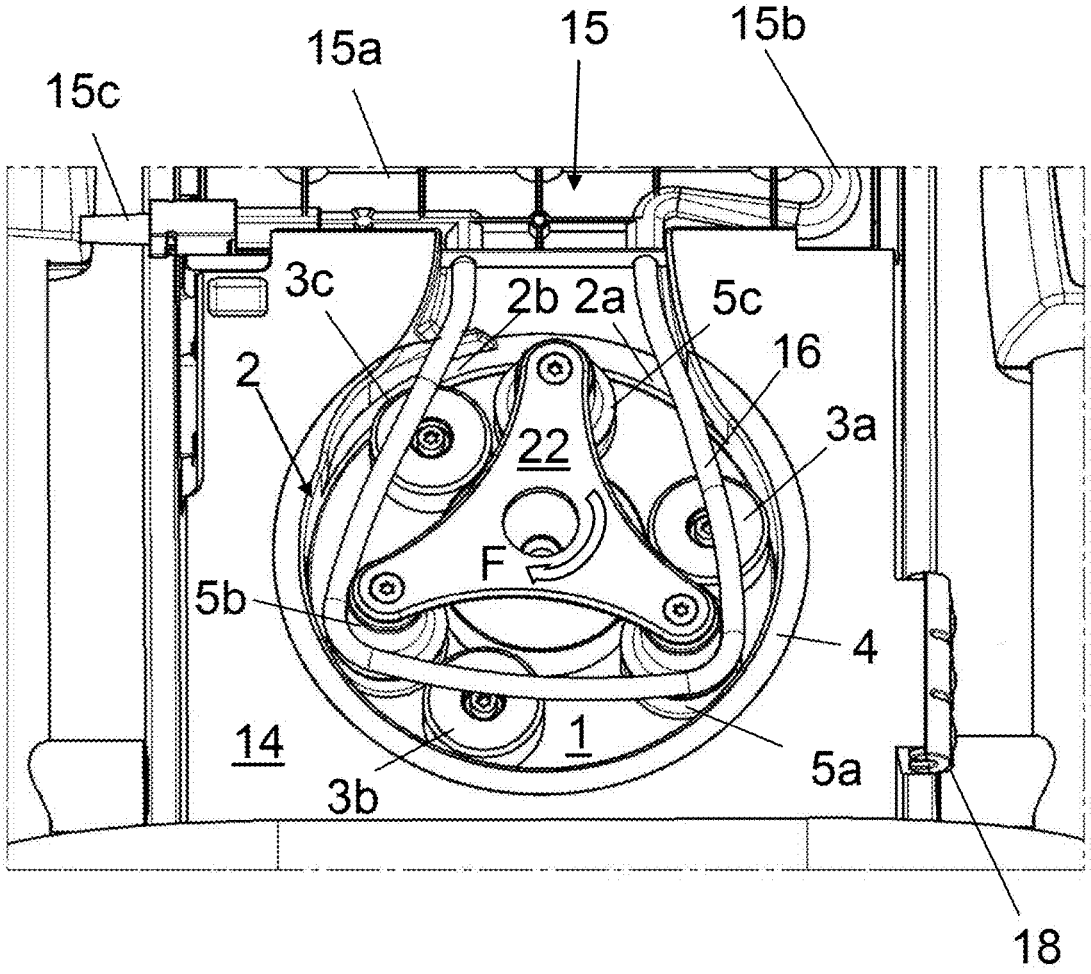
FIG. 1: Perspective view of a peristaltic pump according to the disclosure with a hose inserted therein, the hose being shown in a park position before loading or after unloading.
Figure 2:
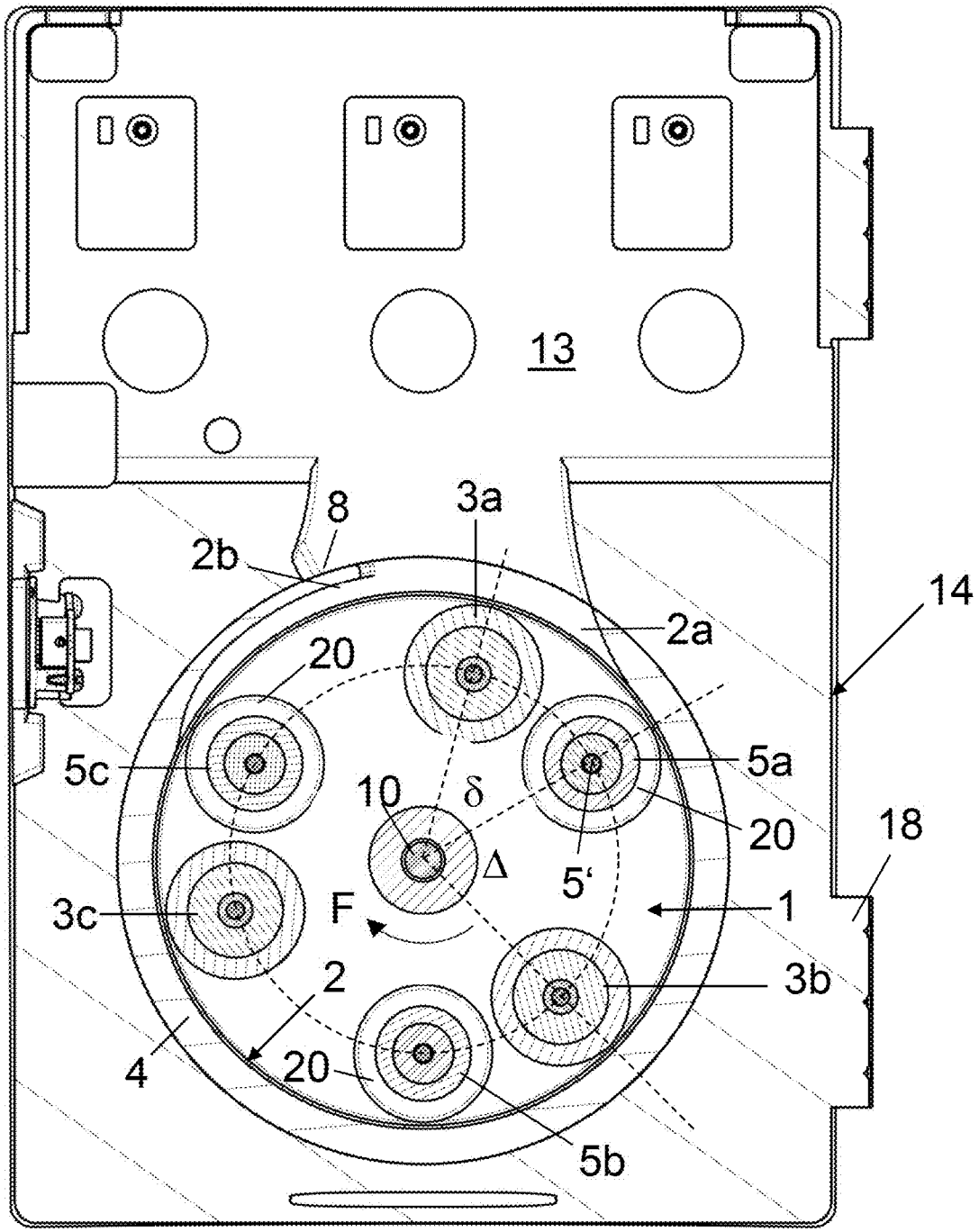
FIG. 2: Cross section of the peristaltic pump of FIG. 1 (section in the center through a lower guide plane of the guide rollers)

FIGS. 1 and 2 show an illustrative embodiment of a peristaltic pump according to the disclosure for conveying a fluid guided in a hose 16, in a perspective view (FIG. 1, with inserted hose 16) and in a sectional view (FIG. 2, with a sectional plane in the center through a lower guide plane of the guide rollers). The peristaltic pump serves to convey an injection fluid for a medical, in particular an intravenous injection, in which the injection fluid is fed from a supply container into a patient hose connected intravenously to the patient. The peristaltic pump is arranged in a pump housing 14 to which a housing cover is pivotably attached by means of a fastening device 18 (not shown here for reasons of clarity). A hold-down device is expediently formed on the housing cover.

The pump housing 14 contains a cassette receptacle 13 designed as a recess in the housing (FIG. 2) for insertion of a replaceable cassette 15 (FIG. 1). The cassette 15 partially shown in FIG. 1 includes a cassette housing 15*a*, in which a guide channel 15*b* is formed. The guide channel 15*b* serves to guide a fluid being conveyed with the peristaltic pump. A loop- or arc-shaped section of the hose 16 then extends out of the cassette housing 15*a*. On the top of the cassette housing 15*a* (not shown here), the cassette 15 is connected to several connection hoses, which can be connected to supply vessels for fluids (for example, injection fluids). A connector 15*c* is arranged on the side of cassette housing 15*a*, to which a patient hose, for example, can be connected in order to connect it to the hose 16.

The peristaltic pump includes a support disk 1, which is coupled to a drive via a drive shaft 10 fastened centrally on the support disk 1. The drive is an electric motor, for example. The support disk 1 is set in rotation when the drive is running via the drive shaft 10 connected non-rotationally to the support disk 1 around an axis of rotation in the feed direction (F). In the illustrative embodiment shown, the feed direction F (direction of rotation of the support disk in pump operation) runs clockwise.

The peristaltic pump also includes a hose bed 2 with a hose inlet 2*a* and a hose outlet 2*b*, as well as a counter bearing 4. The counter bearing 4 is formed by the inside circumference of a circular segment, which is open in the area of the hose inlet 2*a* and the hose outlet 2*b* of the hose bed 2 to introduce a hose 16. The hose bed 2 serves to receive a hose section of a pump hose (the hose section is subsequently also referred to in general as hose 16), in which case a fluid is guided in the hose (for example, an injection fluid for intravenous injection into the bloodstream of the patient. A hose 16 inserted into the hose bed 2 then lies on a guide surface formed by the surface of the support disk 1. In the region of the hose outlet 2*b* of the hose bed 2 the counter bearing 4 runs tangentially outward, as is apparent from the figures.

An unloading device with an elevation 8 protruding above the surface of the support disk 1 is arranged at the hose outlet 2*b*, as described in EP 2 924 288 A2, which is referred to for this purpose.

Several squeeze rollers 3 are mounted to rotate around an axis perpendicular to the support disk 1 on the surface of support disk 1 in the radially outward section (close to its outer circumference). The axes of the squeeze rollers 3 then lie on a circular path running concentrically to the central axis of rotation of the support disk 1 (dashed line in FIG. 2). In the illustrative embodiment of the peristaltic pump according to the disclosure shown here, three such squeeze rollers 3*a*, 3*b*, 3*c* are provided and positioned so as to be uniformly distributed over the circumference of the support disk 1. When reference is subsequently made to the identically designed squeeze rollers 3*a*, 3*b*, 3*c*, this is done with the reference number 3. The squeeze rollers 3 are designed essentially cylindrical with a smooth outer surface and have a front flat top 23.

A guide roller 5 is positioned on the support disk 1 between adjacent squeeze rollers 3. In the illustrative embodiment of the peristaltic pump according to the disclosure shown here three such guide rollers 5*a*, 5*b*, 5*c* are provided and are positioned so as to be uniformly distributed over the circumference of the support disk 1 (and on the circular path shown with the dashed line). When reference is subsequently made to the at least essentially identically designed guide rollers 5*a*, 5*b*, 5*c*, this is done with reference number 5. The guide rollers 5 are mounted so as to rotate on the support disk 1, in which the axes of the guide rollers 5, like the axes of the squeeze rollers 3, run parallel to the drive shaft 10 and also lie on the circular path (dashed circle in FIG. 2) running concentrically to the central axis of rotation of the support disk 1.

The squeeze rollers 3 and the guide rollers 5 can either be mounted freely rotatable on the support disk 1 or coupled via a coupling to the drive of the peristaltic pump. If the squeeze rollers 3 and/or the guide rollers 5 are coupled to the drive via a coupling, they are set in rotation in the direction opposite the direction of the support disk 1 when the drive is running.

The squeeze rollers 3*a*, 3*b*, 3*c* and the guide rollers 5*a*, 5*b*, 5*c* are then positioned on the radially outward edge of the support disk 1 so that the angular distance δ between each guide roller and the squeeze roller following the guide roller in the feed direction is less than 60° and—as in the illustrative embodiment of FIGS. 1 and 2—is in particular 45°. Accordingly, the angular distance Δ between a guide roller and the squeeze roller preceding this guide roller in the feed direction is greater than 60° and in the illustrative embodiment shown, 75°. In the illustrative embodiment shown in FIGS. 1 and 2, the angular distance δ between the guide roller 5*a* and the squeeze roller (3*a*) following this guide roller 5*a* in the feed direction F is therefore δ=45°. This preferred arrangement of the squeeze and guide rollers is described in EP 3 232 059 A2, which is referred to for this purpose.

Figure 3:
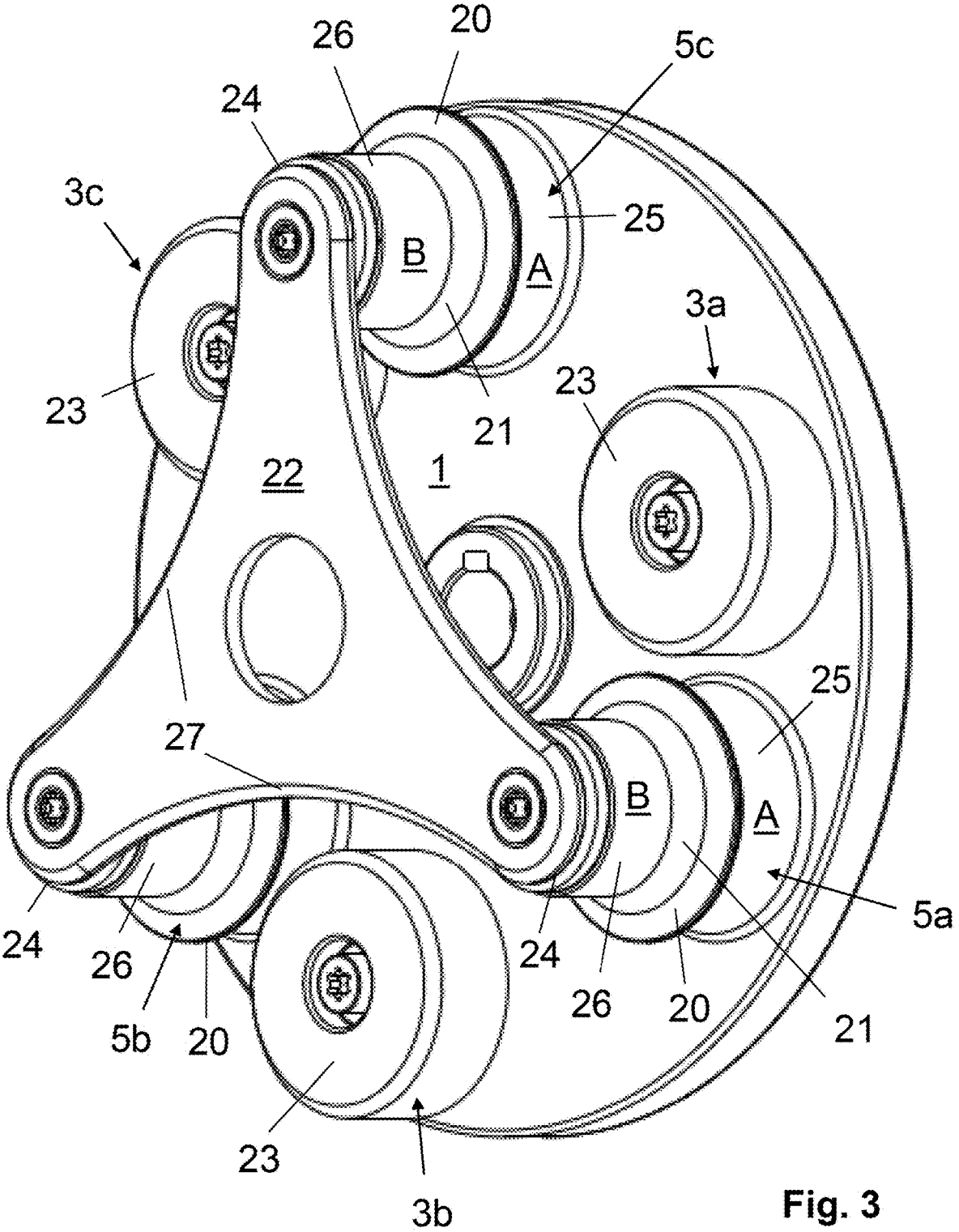
FIG. 3: Detail perspective view of the support disk of the peristaltic pump of FIG. 1 with the squeeze and guide rollers positioned thereon.
Figure 4:
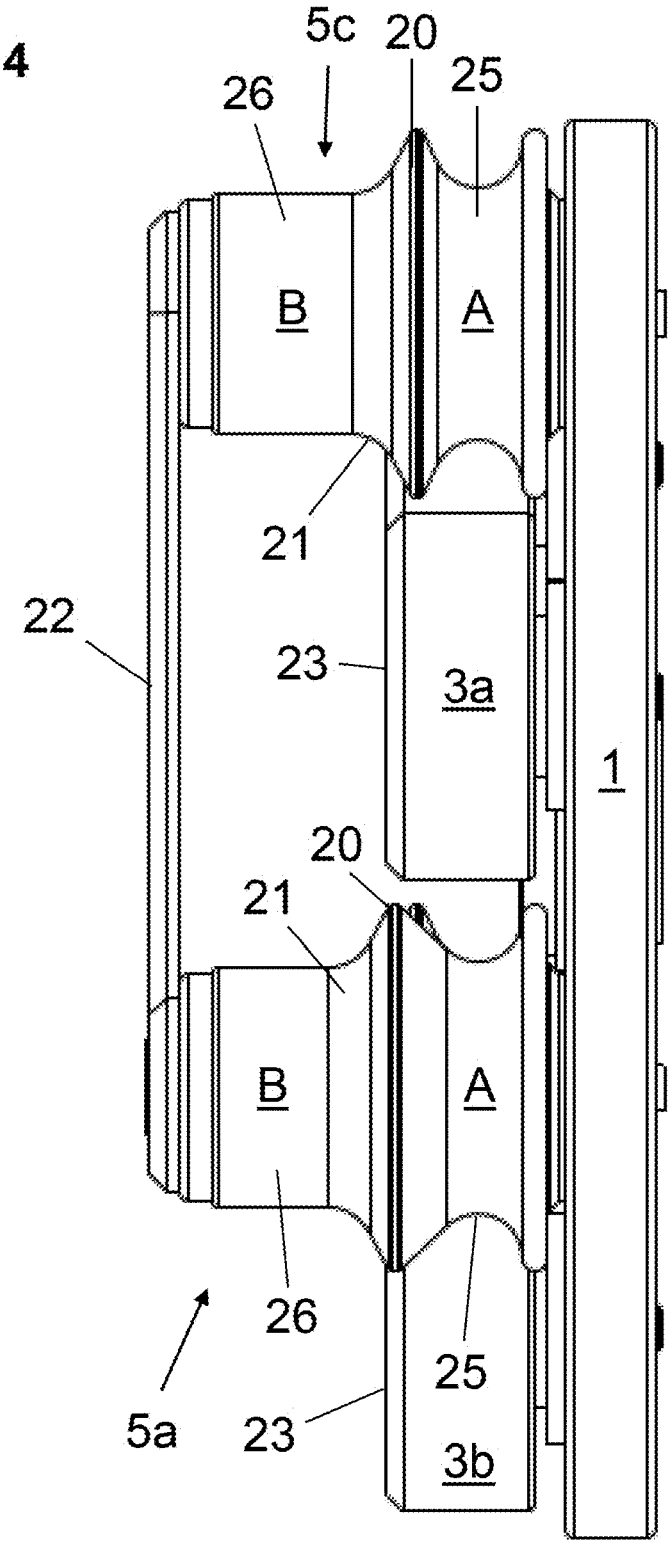
FIG. 4: Side view of the support disk of the peristaltic pump of FIG. 1 with the squeeze and guide rollers 1 positioned thereon.

The structure of the guide rollers 5 is apparent from the detailed view of FIGS. 3 and 4. The guide rollers 5 have an essentially cylindrical basic shape and a guide groove 25 running in the circumferential direction on their outer circumference (on the cylinder surface). The guide grooves 25 of the guide rollers 5 form a first guide plane 25 in which a hose 16 inserted into hose bed 2 is guided by the guide rollers 5 when the peristaltic pump is in operation, in which case the support disk 1, when the pump is running, is set in rotation by the drive and the hose 16 then engages in the guide grooves 25 of the guide rollers 5 and is held by it on the guide surface of the hose bed 2.

Above the guide groove 25 each guide roller 5 has a guide cylinder 26, as is apparent from FIG. 3. The guide cylinder 26 of each guide roller 5 faces away from the support disk 1 and the guide cylinder 26 of the guide rollers 5 form an upper second guide plane B that is arranged offset axially upward relative to the first guide plane A (i.e., pointing away from the support disk 1). The second guide plane B is separated from the first guide plane A by an annular flange 20 running on the outer circumference of each guide roller 5. The bottom of the annular flange 20 then forms the upper section of the guide groove 25 in each guide roller 5 and the top of the annular flange 20 grades into a half-groove 21 with a roughly quarter-circle-shaped cross section, which is a component of the second guide plane B. The height of the guide cylinder 26 of the guide rollers 5 is then adjusted to the diameter of the hose 16 being inserted into the hose bed and corresponds at least to the hose diameter. The height of the guide cylinder 26 is preferably (somewhat) greater than the hose diameter.

The second guide plane B, which is formed by the guide cylinders 26 of the guide rollers 5 and the annular flange 20, then lies above the flat top 23 of the squeeze rollers 3, as is apparent from the side view of FIG. 4. A cover 22 connecting and covering the guide rollers 5 is positioned on the cylinder top 24 formed by the ends of the guide cylinder 26 (the cover 22 has been omitted in FIG. 2 for reasons of clarity). The cover 22 is designed star-shaped here and has a central opening as well as several convex indentations 27.

In the embodiment of the peristaltic pump shown in the drawings, the annular flange 20 in one of the guide rollers 5 (here the guide roller 5*a*) is arranged axially offset upward away from the support disk 1 between the guide groove 25 and the guide cylinder 26 arranged thereabove in comparison with the annular flange 20 of the other guide rollers (here the guide rollers 5*b* and 5*c*). This is apparent from FIG. 4 by comparison of the shape of the guide rollers 5*a* and 5*c* shown there. This guide roller 5*a* with the axially upward offset annular flange 20 has a somewhat modified cross-sectional shape of the guide groove 25 in comparison with the other guide rollers (5*b* and 5*c*) having a cross section somewhat enlarged in the upper section. The cross-sectional shape of the guide groove 25 of guide roller 5*a* with the axially upward offset annular flange 20 therefore deviates somewhat from the shape of the semicircular groove, as is apparent from FIG. 4.

Figure 5:
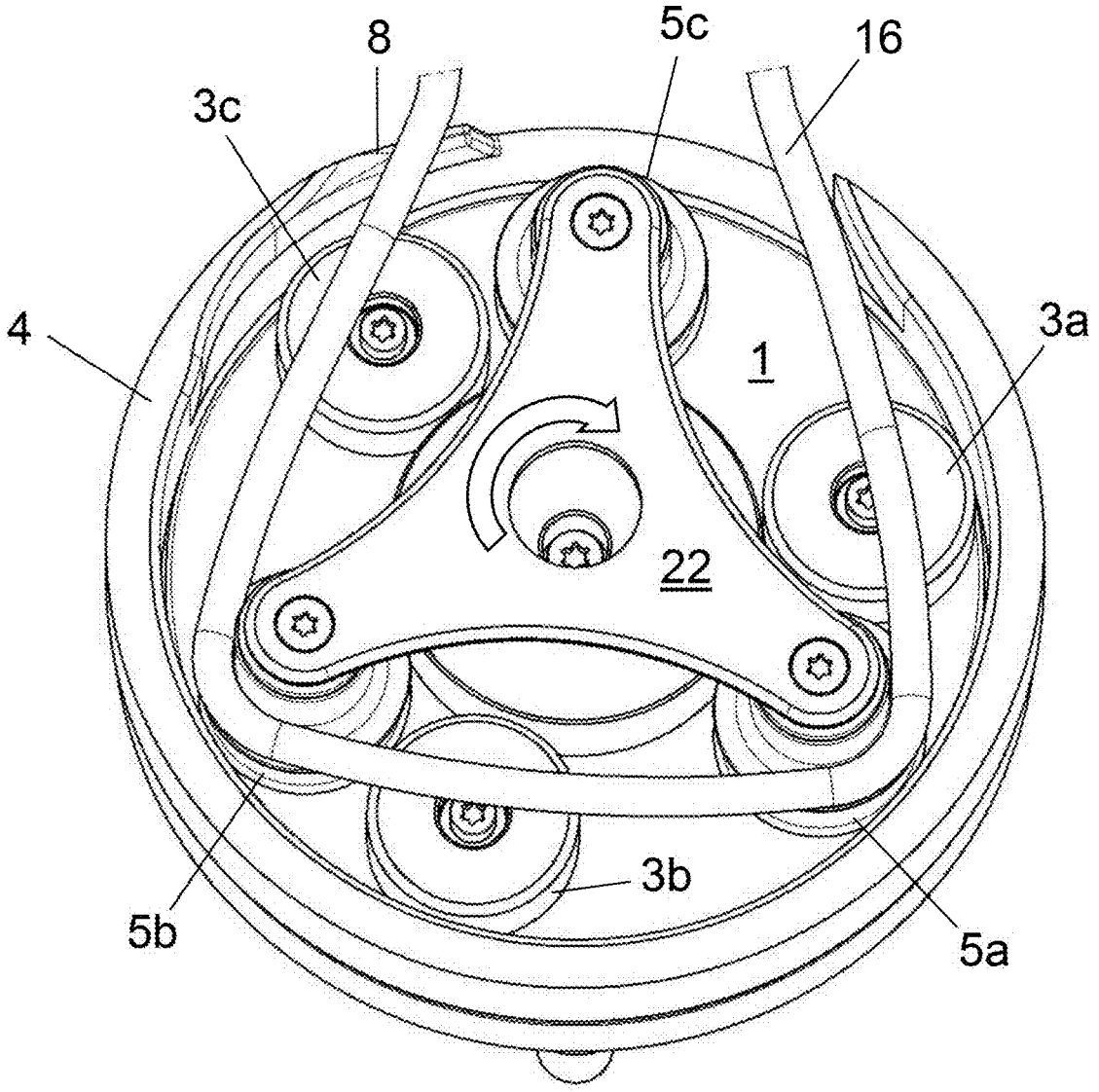
FIGS. 5 to 8: Illustration of the steps of a loading process for loading the hose into the hose bed of the peristaltic pump of FIG. 1.

To operate the peristaltic pump, the section of the pump hose 16 protruding from the cassette housing 15*a* is loaded into the hose bed 2, as explained below with reference to FIGS. 5 to 8:

An operator first places a cassette 15 into the receptacle 13 provided for it on the pump housing 14. After insertion of the cassette 15 into the receptacle 13 provided for it, the section of the hose 16 protruding from the cassette housing 15*a* is positioned manually by the operator around the guide cylinder 26 of the guide rollers 5, as shown in FIG. 5. The hose 16 is then situated in the second guide plane B defined by the guide cylinders 26 of the guide rollers 25. The length of the section of hose 16 protruding from the cassette housing 15*a* is adapted to the geometry of the peristaltic pump so that, when the hose 16 is positioned around the guide cylinders 26 of the guide rollers 5, the hose 16 is placed under a slight prestress and is thereby slightly stretched in its longitudinal direction.

Figure 6:
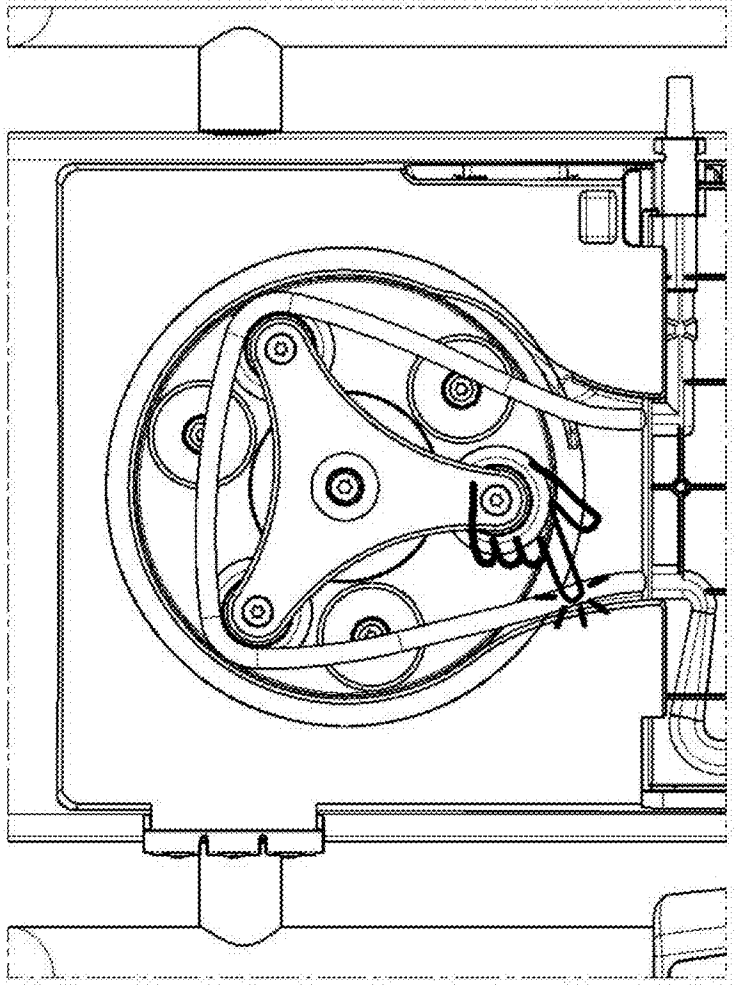

For loading of the hose 16 into hose bed 2, the region of the hose 16 situated at the hose inlet 2*a* of the hose bed 2 is pressed downward in the direction of support disk 1. This can be done manually by the operator with a finger, as shown in FIG. 6. Pressing down of the hose 16 in the region of the hose inlet 2*a* of the hose bed 2, however, can also be done automatically by a mechanical hold-down device. The mechanical hold-down device, for example, can be a lever movably arranged on the pump housing 14. However, the hold-down device can also be positioned on the inside of the cover of the pump housing 14, which is attached so as to pivot on the pump housing 14 by means of the fastening device 18 (the housing cover is not shown in the drawings for reasons of clarity). The hold-down device is then expediently arranged on the inside of the housing cover so that the hold-down device automatically presses the hose 16 placed around the guide rollers 5 downward toward the support disk 1 in the region of the hose inlet 2*a* of the hose bed 2 when the housing cover is closed.

Figure 7:
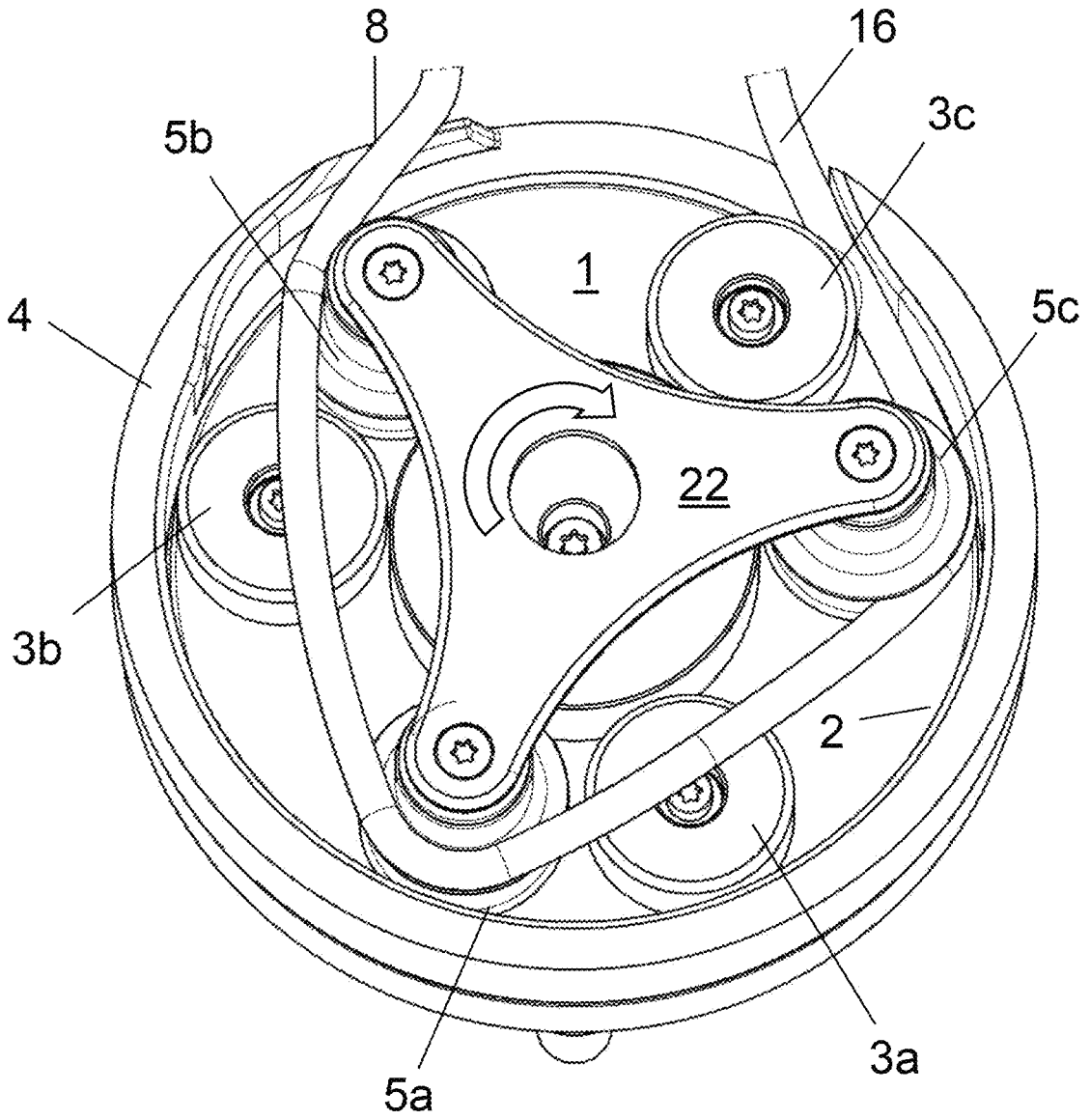

Simultaneously with the pressing down of hose 16 in the region of hose inlet 2*a* of hose bed 2, the support disk 1 is rotated in the feed direction (clockwise in the illustrative embodiment shown). This rotation can be done either manually by the operator or automatically by the drive of the peristaltic pump, which is coupled to the support disk 1. For manual rotation of the support disk 1 the operator can exert a torque on the support disk 1 with a hand via cover 22. The support disk 1 is then rotated in the feed direction (either manually by the operator or automatically by the drive of the peristaltic pump) until the hose 16 engages in the guide groove 25 of a guide roller 5 (this is guide groove 5*c* in FIG. 7). By pressing down the hose 16 in the region of the hose inlet 2*a* of hose bed 2, the hose 16 in this region is brought into the lower first guide plane A in which the guide grooves 25 of the guide rollers 5 are located. If one of the guide rollers 5 passes by the hose inlet 2*a* by rotation of the hose disk 1 in the feed direction (here the guide groove 5*c*, as shown in FIG. 7), the section of the hose 16 situated in the lower first guide plane A will therefore engage in the guide groove 25 of the corresponding guide roller (here: the guide roller 5*c*). Upon further rotation of the support disk 1 in the feed direction, the entire hose 16 is pulled over the entire circumference of the hose bed 2 owing to the guiding in the guide groove 25 of this guide roller 5*c* downward onto the support disk 1 from the upper guide plane B into the lower first guide plane A. The hose 16, because of the somewhat greater wrapping angle in the first guide plane A in comparison to the wrapping angle in the second guide plane B is then stretched slightly further. Owing to the already present prestress of the hose 16, the hose is then also pulled radially inward, for which reason the hose 16 during the loading process has virtually no contact with the counter bearing 14 of the peristaltic pump. Friction of the hose 16 on the counter bearing 4 is therefore minimized during loading of the hose, for which reason any differences in mechanical properties and especially with reference to sliding friction of the hose during the loading process exert no effect. For this reason, with the peristaltic pump according to the disclosure, different hoses, especially hoses made of different materials and with different friction characteristics, can, in the same way, always be loaded precisely and reliably into the hose bed 2.

Figure 8:
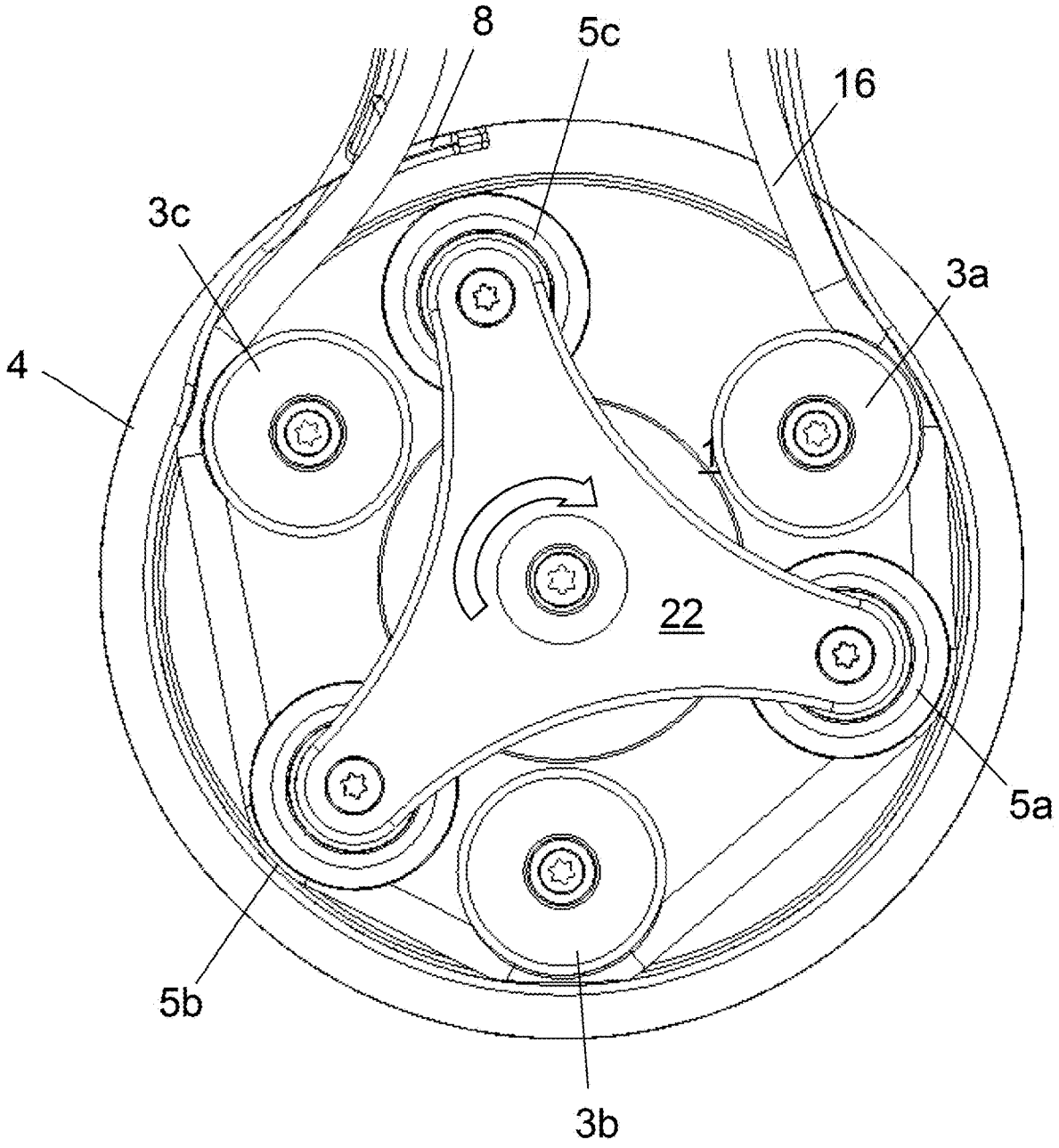

As soon as the support disk 1 during the loading process has made a complete rotation (i.e., by 360°), the hose 16 is fully situated in the lower first guide plane A as shown in FIG. 8 and is fully introduced in hose bed 2 on this account. The peristaltic pump is now ready for operation to convey a fluid located in hose 16.

After loading of the section of the hose 16 protruding from the cassette into the hose bed 2 in the manner just described, the pump can be operated to convey the fluid located in the hose in its feed direction F. For this purpose, the support disk 1 in the illustrative embodiment shown here is set in rotation by the drive in the feed direction (here: clockwise), so that the squeeze rollers 3 force the hose intermittently with squeezing against the counter bearing 4 and in so doing transport the fluid located in the hose in the feed direction. The guide rollers 5 then ensure reliable and equivalent positioning of the section of the hose 16 in the hose bed 2 in which the hose engages in the guide grooves 25 of the guide rollers 5 and is guided by them.

When the hose 16 has been properly loaded into the hose bed 2, it is guided by the guide groove 25 of the guide rollers 5 and then runs at a small distance from and essentially parallel to the surface of the support disk 1 and between the outer circumference of the squeeze rollers 3 and the counter bearing 4. The (radial) distance between the outer circumference of the squeeze rollers 3 is then chosen smaller than the diameter of the hose 16 so that the hose is clamped between the outer circumference of the squeeze rollers 3 and counter bearing 4 with squeezing of the flexible hose.

If during the loading process the section of hose 16 pressed downward in the hose inlet area 2*a* is not grasped by a guide roller 5 passing the hose inlet 2*a* (the guide roller 5*c* in FIG. 7) in its guide groove 25, the support disk 1 is further rotated in the feed direction until the next feed roller on the support disk 1 in the feed direction (the guide roller 5*b* in FIG. 7) passes by the hose inlet 2*a*. If necessary, this can be repeated until the hose 16 engages in a guide groove 25 of one of the guide rollers 5.

As explained above, the guide roller 5*a* in comparison with the other guide rollers 5*b*, 5*c* has an annular flange 20 arranged offset upward and therefore an enlarged insertion cross section in the region of its guide groove 25. The enlarged insertion cross section of the guide roller 5*a* can ensure that the section of the hose 16 pressed downward in the region of the hose inlet 2*a* is grasped in each case by the guide groove 25 of this guide roller 5*a* and therefore pulled from the upper, second guide plane B into the lower, first guide plane A. At the latest [sic?], if the guide roller 5*a* with the annular flange 20 arranged offset upward enters the area of the hose inlet 2*a*, the hose is grasped by the guide groove 25 of this guide roller 5*c* and upon further rotation of the support disk is pulled downward into the lower first guide plane A.

To monitor the loading process a corresponding device is expediently provided in the peristaltic pump. This device for monitoring the loading process can include, for example, a device to detect the torque acting on the support disk 1. As soon as the hose has been fully brought into the lower first guide plane A during the loading process, the rotational resistance of the support disk 1 increases, for which reason the drive of the peristaltic pump must apply a higher torque for further rotation of the support disk 1 (with the same rotational speed). By detecting the torque acting on the support disk 1, a conclusion can therefore be drawn concerning the status of the loading process. As soon as the torque acting on the support disk 1 exceeds a stipulated torque threshold value, a signal emitter produces a signal indicating to the operator that the hose 16 has been properly inserted into the hose bed 2.

In the event that a loading process could not be completed properly, despite repeated attempts, it can be provided that the signal emitter produces a second signal after a stipulated time has elapsed, if the stipulated torque threshold value was not been reached or exceeded within this time. When the second signal is output, the operator receives the information that the loading process was not successful. In this case, the operator can insert a different cassette 15 into the receptacle 13 provided for this on the peristaltic pump and start a new loading process.

If blockage of the peristaltic pump occurs during a loading process, for example, due to jamming of the hose 16, this is also detected by the device for monitoring the loading process and the signal emitter can produce a corresponding signal. In the case of a pump blockage, the loading process is blocked, and the operator is required to insert a new cassette 15.

The signals can then be produced, for example, in the form of an acoustic signal or in the form of an indication on a display.

Figure 9:
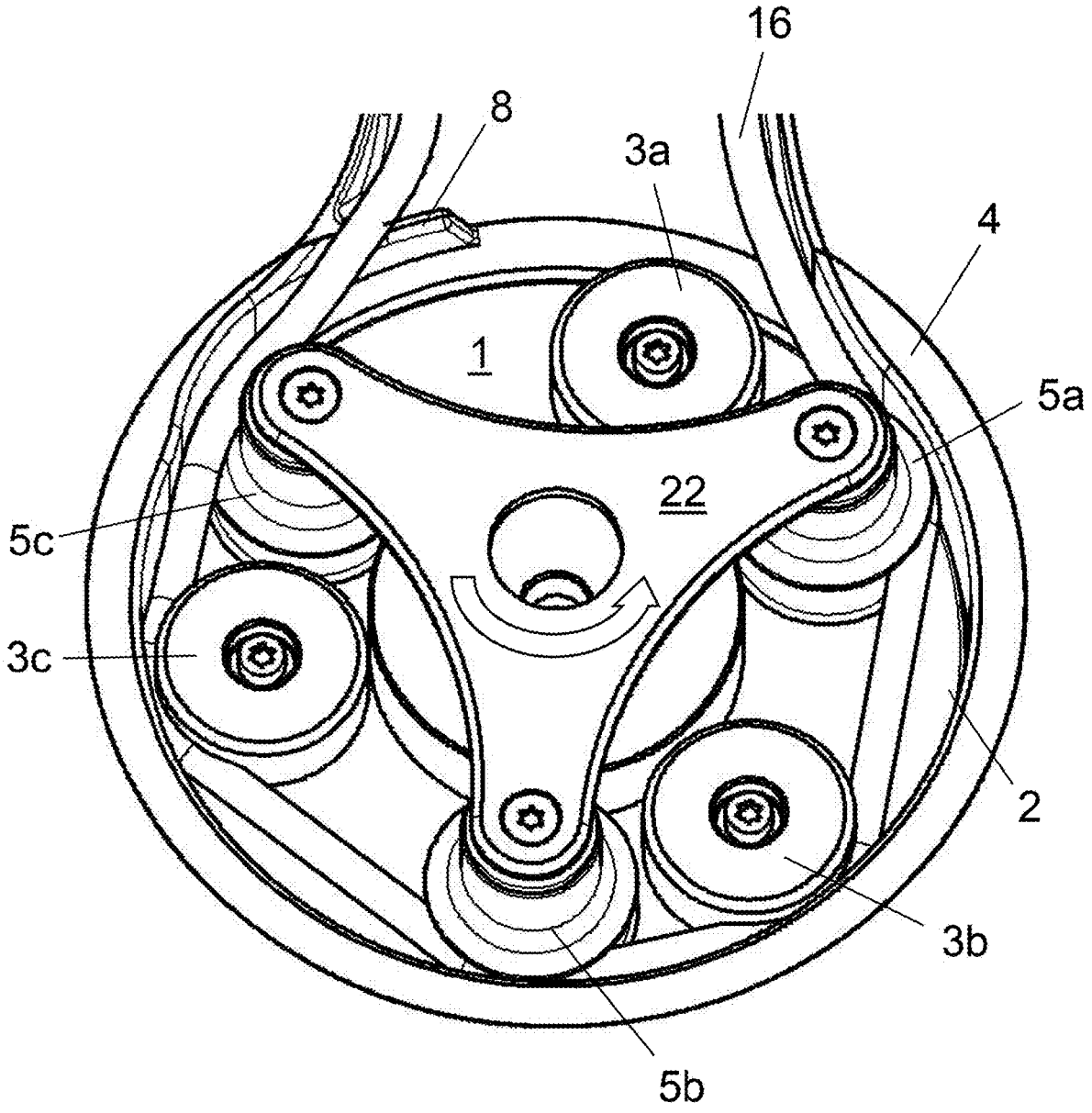
FIG. 9: Illustration of an unloading process for unloading the hose from the hose bed in the peristaltic pump of FIG. 1.

After operation of the peristaltic pump has been completed, the hose 16 can be unloaded from the hose bed 2 via an automatic unloading routine. For this purpose, the support disk 1 is rotated by the drive of the peristaltic pump counter to the feed direction (i.e., counterclockwise in the illustrative embodiment shown). The protrusion 8 arranged at the hose outlet 2*b* of the hose bed 2 and apparent from FIG. 9 is used to unload the hose. The protrusion 8 protrudes above the surface of the support disk 1 and lifts the hose 16 in the area of the hose outlet 2*a* slightly above the surface of the support disk 1. During a rotation of the support disk 1 counter to the feed direction (counterclockwise), the guide roller 5*c*, which is moved past the hose outlet 2*a* by rotation of the support disk 1, engages the hose 16 with its annular flange 20 and raises it from the lower first guide plane A into the upper second guide plane B, as shown in FIG. 9. Upon further rotation of the support disk 1 counter to the feed direction, the hose 16 is raised above the entire circumference of the hose bed 2 from the lower first guide plane A into the upper second guide plane B until, after a complete revolution of the support disk 1 (by 360°) counter to the feed direction, the hose 16 is situated fully and over the entire circumference of the hose bed 2 in the upper second guide plane B (according to the position shown in FIG. 5). In this position the hose 16 can be pulled upward by the operator from the guide rollers 5 and removed together with the cassette 15 from the peristaltic pump.

The device for monitoring the loading process is preferably coupled to a control device of the peristaltic pump. This enables performance of programmed loading and unloading routines by the control device, in which the device for monitoring the loading process records the status of the loading process and, if necessary, starts the loading process again, if the hose could not be successfully loaded, or ends the loading process if the hose could be successfully loaded. The same applies for the unloading process.

The disclosure is not restricted to the embodiment shown here in the drawings. For example, the number of squeeze rollers 3 and guide rollers 5 could be chosen differently. However, it is expedient to provide the same number of guide rollers and squeeze rollers so that each squeeze roller 3 is assigned a guide roller 5. For example, four squeeze rollers 3 and four guide rollers 5 can be provided, which are positioned in alternating sequence on the support disk 1 so that their axes lie on a circular path running concentrically around the axis of rotation A of the support disk 1. The angular distances between the squeeze rollers and between the guide rollers are equidistant from each other. With four guide and squeeze rollers each, this distance between the guide and squeeze rollers is 90°. The angular distance between the squeeze rollers 3 and the guide rollers 5 can expediently be different, as described above, or also be equidistant.

Instead of cover 22 (or in addition to it) a central cylinder protruding above the surface of the support disk 1 can be arranged at the center of the support disk 1 coaxial to its axis of rotation, which cylinder encloses the drive shaft 10 and whose outside diameter reaches at least roughly to the outer circumference of the radially farther outward lying squeeze rollers and guide rollers. A (smallest) possible distance then exists between the outer circumference of the central cylinder and the outer circumference of the squeeze rollers and the guide rollers. The central cylinder can be designed as a hollow cylinder or also as a solid cylinder and is expediently connected nonrotationally to the support disk 1. During loading of the hose the central cylinder prevents it from lying on the radially inward-facing side of the guide rollers 5 and therefore from being loaded properly into the hose bed 2 between the outer circumference of the squeeze rollers 3 and the counter bearing 4. For this purpose, the radial distance between the outer surface of the cylinder and the outside circumference of the guide rollers should be smaller than the diameter of the hose being introduced to the hose bed. The height of the central cylinder (in the axial direction) is then expediently adjusted to the height of the guide rollers and has at least the same height as the guide rollers.

What is claimed is:

1. A peristaltic pump for conveying a fluid guided in a hose, the peristaltic pump comprising a hose bed having a counter bearing to accommodate the hose, a support disk rotatable relative to the counter bearing, a plurality of squeeze rollers positioned on the support disk and a plurality of guide rollers positioned on the support disk, wherein each guide roller is provided with a guide groove extending on an outer circumference of the respective guide roller, wherein the guide groove of each guide roller forms a first guide surface facing the support disk, the first guide surface guiding the hose during pumping a fluid guided in the hose, wherein each guide roller has a guide cylinder above the respective guide groove to guide the hose during loading into the hose bed and/or during unloading from the hose bed, wherein an annular flange extending on the outer circumference of the guide roller is positioned in each guide roller between the guide groove and the guide cylinder; and wherein for at least one guide roller of the plurality of guide rollers the annular flange is positioned offset away from the support disk between the guide groove and the guide cylinder in comparison to the annular flange of the other guide rollers.

2. The peristaltic pump according to claim 1, wherein in each guide roller the guide cylinder together with the annular flange forms a second guide surface positioned offset axially to the first guide surface, and wherein the hose is guided by at least one guide roller of the plurality of guide rollers in the second guide surface during loading and/or during unloading the hose.

3. The peristaltic pump according to claim 2, wherein the second guide surface serves for initial guiding of the hose and/or for introduction of a tensile stress onto the hose during loading into the hose bed.

4. The peristaltic pump according to claim 2, wherein the first guide surface and the second guide surface of each guide roller are separated from each other by the annular flange.

5. The peristaltic pump according to claim 2, wherein the second guide surface of each guide roller includes a half-groove extending on the outer circumference of the respective guide roller.

6. The peristaltic pump according to claim 1, wherein a height of the guide cylinder in each guide roller is at least as large as a diameter of the hose.

7. The peristaltic pump according to claim 1, wherein the squeeze rollers are designed with a flat top, wherein the guide cylinder of each of the guide rollers lies in the axial direction above the top of each squeeze roller.

8. The peristaltic pump according to claim 1, wherein each guide roller has a top formed by an upper end of the guide cylinder and wherein a cover connecting the guide rollers is positioned on the top of each guide roller.

9. The peristaltic pump according to claim 8, wherein the cover is designed cross-shaped or star-shaped.

10. The peristaltic pump according to claim 9, wherein the cover has indentations in a region between two adjacent guide rollers, and wherein the indentations are convex, rectangular or in the form of a partial circle.

11. The peristaltic pump according to claim 1, wherein the guide groove of at least one guide roller has at least essentially a partially circular cross section.

12. The peristaltic pump according to claim 1, wherein the guide groove of at least one guide roller has a semicircular cross section.

13. A peristaltic pump for conveying a fluid guided in a hose, the peristaltic pump comprising:

a hose bed having a counter bearing to accommodate the hose, a support disk rotatable relative to the counter bearing, a plurality of squeeze rollers positioned on the support disk and a plurality of guide rollers positioned on the support disk, wherein each guide roller is provided with a guide groove extending on an outer circumference of the respective guide roller, wherein the guide groove of each guide roller forms a first guide surface facing the support disk, the first guide surface guiding the hose during pumping a fluid guided in the hose, wherein each guide roller has a guide cylinder above the respective guide groove, wherein in each guide roller an annular flange extending on the outer circumference of the respective guide roller is positioned between the guide groove and the guide cylinder, wherein in each guide roller, the guide cylinder together with the annular flange forms a second guide surface which is positioned offset axially to the first guide surface, and is formed by a half-groove which has the cross section of a quarter circle, and wherein the hose is guided in the second guide surface of at least one guide roller of the plurality of guide rollers during loading and/or during unloading the hose.

14. A peristaltic pump for conveying a fluid guided in a hose, the peristaltic pump comprising:

a hose bed having a counter bearing to accommodate the hose, a support disk rotatable relative to the counter bearing, a plurality of squeeze rollers positioned on the support disk, a plurality of cylindrical guide rollers positioned on the support disk, each of the plurality of guide rollers having an outer circumference with a guide groove extending on the outer circumference, the guide groove defining a first guide surface facing the support disk, wherein each guide roller has a guide cylinder positioned above the guide groove, the guide cylinder defining a second guide surface facing away from the support disk, wherein loading the hose into the hose bed includes:

insertion of the hose into the second guide surface, rotation of the support disk in a feed direction so that the hose is brought from the second guide surface into the first guide surface in the axial direction toward the support disk, wherein for automatic unloading the hose from the hose bed, the peristaltic pump further comprises an unloading device, wherein, during operation of the peristaltic pump, unloading the hose from the hose bed is done by means of the unloading device, which unloading includes:

rotation of the support disk in a direction counter to the feed direction, initially transferring the hose from the first guide surface upward into the second guide surface, and then guiding the hose in the second guide surface.

15. The peristaltic pump according to claim 14, wherein during loading the hose into the hose bed, a preload is produced on the hose during insertion of the hose into the second guide surface of the guide rollers.

16. The peristaltic pump according to claim 14, further comprising a sensor with which a torque acting on the support disk is detected during loading the hose into the hose bed.

17. The peristaltic pump according to claim 16, wherein when the sensor detects a torque above a torque threshold value, a first signal is produced and wherein a second signal is produced if after a stipulated time has elapsed, the torque threshold value was not reached or exceeded.

* * * * *